US007434521B2

(12) United States Patent
Lombardi

(10) Patent No.: US 7,434,521 B2
(45) Date of Patent: Oct. 14, 2008

(54) MASON'S ADJUSTABLE CHIMNEY-PLATFORM ARRANGEMENT

(76) Inventor: Donald F. Lombardi, 1 Ledgewood Rd., Manchester, MA (US) 01944

( * ) Notice: Subject to any disclaimer, the term of this patent is extended or adjusted under 35 U.S.C. 154(b) by 253 days.

(21) Appl. No.: 11/499,374

(22) Filed: Aug. 5, 2006

(65) Prior Publication Data

US 2008/0030037 A1 Feb. 7, 2008

(51) Int. Cl.
*B65D 19/38* (2006.01)

(52) U.S. Cl. ..... 108/54.1; 108/102; 108/137; 182/141; 182/222; 280/6.152

(58) Field of Classification Search ..... 108/27, 108/54.1, 102, 106, 137, 138, 141, 144.11; 182/130, 141, 150, 222; 280/6.15, 6.152
See application file for complete search history.

(56) References Cited

U.S. PATENT DOCUMENTS 3,664,456 A * 5/1972 Smith et al. ..... 182/62.5
5,850,892 A * 12/1998 Citron et al. ..... 182/148
6,276,488 B1 * 8/2001 Divine et al. ..... 182/2.11
6,349,793 B1 * 2/2002 Kincaid ..... 182/69.4
2005/0173192 A1 * 8/2005 Waisanen et al. ..... 182/141
2005/0226707 A1 * 10/2005 Quenzi et al. ..... 414/482
2005/0241878 A1 * 11/2005 Cook ..... 182/115

* cited by examiner

*Primary Examiner*—Lori L Lyjak
(74) *Attorney, Agent, or Firm*—Don Halgren

(57) ABSTRACT

An adjustable, articulable platform, changeable to and from a "U" shape to an "H" shape, is attachable to the distal end of an articulable support arm of a transport vehicle. The platform is arranged to adjustably surround an elevated chimney on at least three sides thereof. The platform comprises: a lower anchor plate centrally disposed within an elongated lower support frame; a rear anchor plate connected perpendicularly to the lower anchor plate, the rear anchor plate centrally and connectively disposed within an elongated rear wall frame, comprising bridging portions of the platform. A right sidewall frame and a left sidewall frame is connected to respective end portions of the elongated rear wall frame. A right slidable sidewall is slidably disposed within the right sidewall frame, and a left slidable sidewall is slidably disposed within the left sidewall frame, to permit forward and rearward adjustability to side rail and floor portions thereof around an elevated structure for supporting personnel and equipment therefor. Those side rail and floor panel portions are also adjustable transversely to squeeze closed together or slightly further apart according to the width of any chimney or the like. Such sideways adjustment is accomplished by supportive engagement of the mid portion of the rear wall frame and floor panel of its adjacent wall and floor panels.

16 Claims, 17 Drawing Sheets

MASON'S ADJUSTABLE CHIMNEY-PLATFORM ARRANGEMENT

BACKGROUND OF THE INVENTION

1. Field of the Invention

This invention relates to lift platforms to facilitate chimney construction, and more particularly to articulable lift platforms attachable to mechanical arm arrangements to be utilized for construction at above the ground locations.

2. Prior Art

The construction industry, particularly that which is involved in the home and building field have a difficult time reaching elevated structures, such as chimneys on roofs or the like, to rebuild them or to get around them. Often those structures are several stories high off of the ground. Movement and work space around them is too often very limited.

Those in the masonry business may readily attest to this. Getting bricks, mortar and personnel to an elevation several stories above the ground, and keeping them there in a safe and stable manner where they can productively work is something much to be desired.

It is an object of the present invention, to overcome the disadvantages of the prior art.

It is a further object of the present invention to provide an articulable platform which is adapted to the attached to the distal end of an articulable arm, for safe hoisting and lowering of personnel and equipment to a roof of a building.

It is a further object of the present invention, to provide an articulable platform which may be adapted to the particular construction irregularities of a particular work site.

It is still yet another object of the present invention, to provide a work space or platform which is maneuverable, safe and has the ability to be changed and controlled in its elevated most position.

BRIEF SUMMARY OF THE INVENTION

The present invention comprises an articulable platform which is securable to the distal end of an articulable arm. The articulable arm is typically telescopingly arranged on the distal end of a movable arm supported on a lift truck. The lift truck provides a mobile base from which the articulable platform may be moved and adjusted.

The articulable arm has a distalmost end with a securement member thereon. The platform has a lower anchor plate and a lower support frame to which the securement member is attached, by a bolt and slider mechanism. A rear wall plate is attached to the lower anchor plate and the lower support frame. A right sidewall frame and a left sidewall frame are attached to the respective side edges of the rear wall frame.

The respective sidewall frames each have an upper elongated channel and a lower elongated channel. The sidewall frames each slidably support a slidable side wall. An upper right rail of a right slidable side wall slides through the upper elongated channel of the right sidewall frame. A lower rail of the right slidable side wall slides through the lower elongated frame of the right sidewall frame. The right slidable side wall has a transverse bar at its distalmost end and it has a transverse bar. The right slidable sidewall has a right-side proximal transverse bar at the rear end of the right slidable sidewall. The right-side proximal transverse bar butts into a right sidewall frame transverse bar when the right slidable sidewall is extended distally its maximum amount.

The left sidewall frame has a left slidable sidewall arranged in a similar manner to the aforementioned right sidewall frame. An upper left rail of a left slidable sidewall slides through the upper elongated channel of the left sidewall frame. A lower rail of the left slidable side wall slides through the lower elongated frame of the left sidewall frame. The left slidable sidewall has a transverse bar at its distalmost end and it has a transverse bar. The left slidable sidewall has a left-side proximal transverse bar at the rear end of the left slidable sidewall. The left-side proximal transverse bar butts into a left sidewall frame transverse bar when the left slidable sidewall is extended distally its maximum amount.

The right sidewall frame and the left sidewall frame may in one embodiment, each have a fold down floor panel member arrangement with a hinge arranged along a lower portion thereof. Each left and right slideable sidewall has a lower bar which moves along with their respective left and right slidable sidewalls, the lower bar of each being hingedly attached to an elongated side plate which may be pivoted into supported engagement with a portion of the rear floor on each side of the lower anchor plate.

In operation of the articulable platform on the distal end of the articulable arm on the lift truck, that articulable platform may engageably receive between its elongated side floors, any chimney or vertical structure therebetween. Those slidable sidewalls may be moved forwardly and rearwardly, that is away from and back towards the rear wall frame. Such sidewall movement effects a change in the "plan" view of the platform, that is, from an "H" shape to a "U" shape with variable side positions or a variable "bridging" portion length. For instance, if the platform were utilized above a chimney on a slanted roof, the slidable sidewalls would only be independently extended from their respective right sidewall frame and left sidewall frame enough to clear the sides of the chimney without damaging any inclined roof there adjacent. To fully surround a chimney or structure, those independently slidable sidewalls would be extended away from the rear wall frame so as to provide the elongated side floors their full extendibility thereadjacent. The distal end of those side floors may also be rested upon he sloping side of the roof through which the chimney extends.

It is further contemplated that a front floor plate with a front wall may be adjustably and removably disposed between the distalmost end of the respective elongated side floors with a corner attachment coupler secured at each end of the front floor plate wall to the ends of the respective left and right slidable sidewalls. The front wall and front floor plate may be hingedly attached to one another by an elongated hinge along their lower portion thereof.

Insert panels may be disposed between the chimney and the elongated edges of the elongated side floors and the edges of the rear floor and the front floor for in close support of personnel and material on the platform.

The invention thus comprises a generally "U" to "H" (or vice versa) shaped distributively adjustable articulable platform, attachable to the distal end of an articulable support arm of a transport vehicle. The platform is arranged to adjustably surround an elevated chimney on at least three sides thereof. The platform may be comprised of: a rectilinear lower anchor plate centrally disposed within an elongated lower support frame, a rectilinear rear anchor plate connected perpendicularly to the lower anchor plate, the rectilinear rear anchor plates centrally and connectively disposed within an elongated rectilinear rear wall frame, all comprising a "bridging" portion, a right sidewall frame and a left sidewall frame connected to respective end portions of the elongated rear wall frame, connected to respective end portions of the lower support frame; and a right slidable sidewall slidably disposed within the right sidewall frame, and a left slidable sidewall slidably disposed within the left sidewall frame, to provide adjustable portions thereof around an elevated structure (chimney) for supporting personnel and equipment therefor. The left slidable sidewall and the right slidable sidewall may each have an elongated lower portion with a hinge thereon, each of the hinges being attached to an elongated side floor, each of the side floors being in pivotable engagement with and slidable support with respect to the lower support plate of the platform for support thereof. Each of the slidable sidewalls are preferably movable independently of one another. An elongated front floor may be nestably disposable between the elongated side floors when the side floors are disposed in a horizontal orientation. The front floor is preferably hingedly attached to a front wall to provide full peripheral enclosure by a succession of wall members on the platform in an elevated orientation, while surrounding a chimney. The platform may include a plurality of plate inserts, the plate inserts being supported upon edge portions of the hingedly attached side floors and the hingedly attached front floor. The right and left sidewall frames preferably have elongated channels, and the slidable sidewalls have elongated structure members which are arranged to telescopingly slide through the channels for support of the side walls in the side wall frame.

The invention also comprise a method of supporting a work crew on an elevated chimney work site, comprising one or more of the following steps of: attaching a generally "U" to "H" or "H" to "U" shaped (in a plan view) articulable platform assembly to the distal end of an articulable support arm of a transport vehicle, wherein the platform is arranged to adjustably surround an elevated chimney on at least three sides thereof, wherein the platform is comprised of a rectilinear lower anchor plate centrally disposed within an elongated lower support frame, a rectilinear rear anchor plate connected perpendicularly to the lower anchor plate for attachment to an articulable arm on a mobile transport, the rectilinear rear anchor plates centrally and connectively disposed within an elongated rectilinear rear wall frame, a right sidewall frame and a left sidewall frame connected to respective end portions of the elongated rear wall frame, and connected to respective end portions of the lower support frame, a right slidable sidewall telescopingly slidably disposed within the right sidewall frame, and a left slidable sidewall telescopingly slidably disposed within the left sidewall frame, to provide adjustable portions thereof around an elevated (chimney) structure for supporting personnel and equipment therefor; moving the right sidewall and the left sidewall independently with respect to one another to adjust the distribution of the sides of the platform relative to a chimney. The method may include the step of: placing a shoulder edge of a further rectilinear support frame adjacent to and supportively on an edge of at least two adjacent rectilinear support panel plates on the platform assembly.

The invention also comprises an adjustable platform for supporting workers and supplies about an elevated work site, said platform movably supportable on an articulable support arm. The platform comprises an elongated rectilinear bridging panel arrangement and an elongated floor and railing assembly at each end thereof, wherein each elongated floor and railing assembly are independently movable on support members forwardly and rearwardly with respect to the bridging panel arrangement to change the platform from an "H" shape to a "U" shape as required. The bridging panel member portion may be elongatedly adjustable to change the width of the platform relative to a work project dimension.

BRIEF DESCRIPTION OF THE DRAWINGS

The objects and advantages of the present invention will become more apparent, when viewed in conjunction with the following drawings in which.

DETAILED DESCRIPTION OF THE PREFERRED EMBODIMENT

Figure 1:
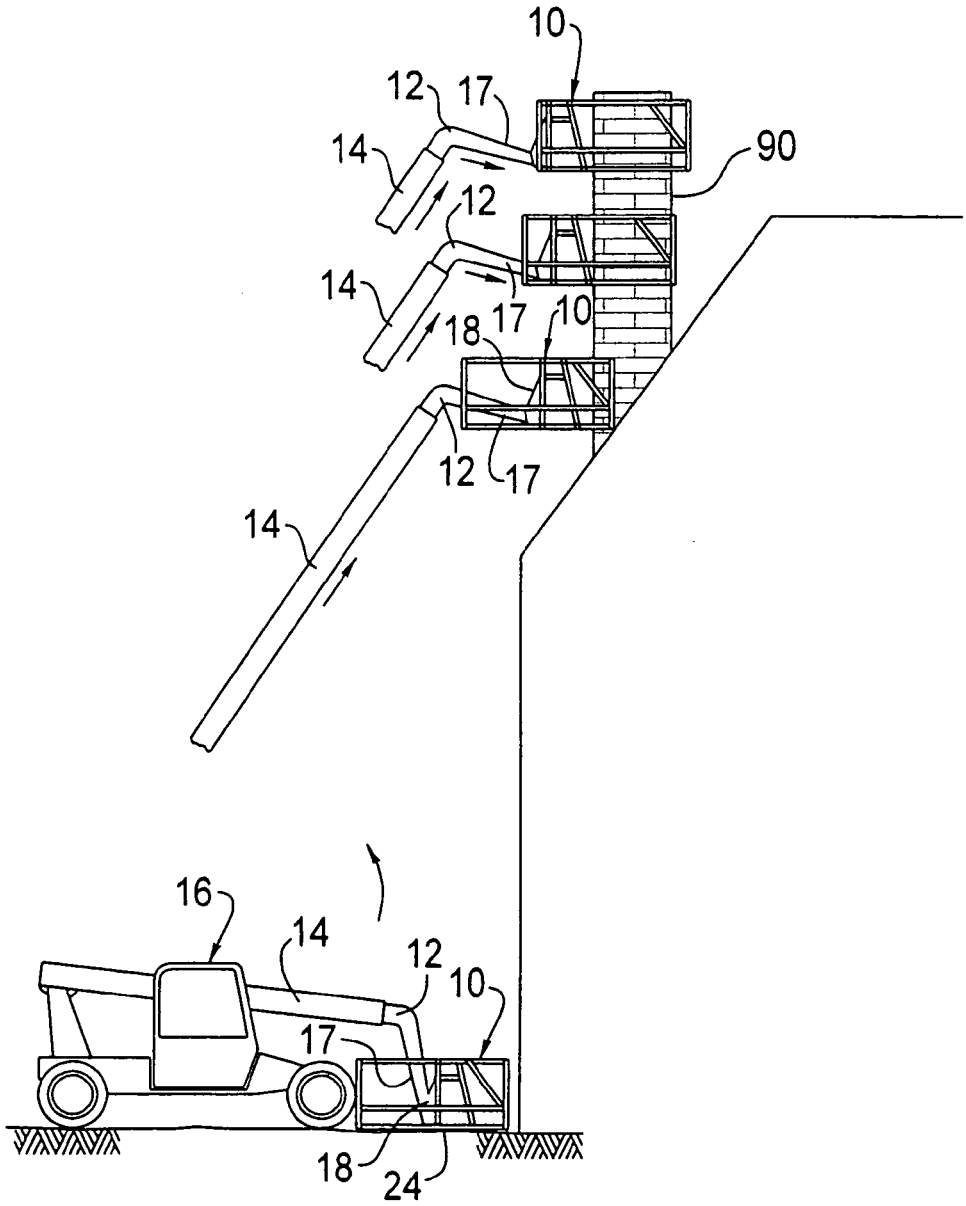
FIG. 1 is a side elevational view of a lift truck and arm arrangement adapted to move an articulated platform, in a side elevational view shown in several positions of the platform against a building structure.

Referring now to the drawings in detail, and particularly to FIG. 1, there is shown the present invention which comprises an articulable platform 10 that is securable to the distal end of an articulable arm 12. The articulable arm 12 is typically telescopingly arranged on the distal end of a movable arm 14 supported on a lift truck 16. The lift truck 16 provides a mobile base from which the inventive articulable platform 10 may be moved and adjusted around an elevated chimney 90, or the like, to provide a mason's platform during work on that chimney 90.

The articulable arm 12 has a distalmost end 17 with a generally "L" shaped (in cross-section) platform securement member 18 thereon. The articulable platform 10 has a preferably rectangularly-shaped lower anchor plate 20 and an elongated rectangular, lower peripheral support frame 22 to which the lower extremity of the "L" shaped platform securement member 18 is attached at several points, by a bolted anchor mechanism 24, as partially represented in FIG. 1. A rear anchor plate 26 is ridgidly and fixedly attached, as for example by welding, in a perpendicular manner to the bottom side of the lower anchor plate 20 and the lower support frame 22. The securement member 18 also preferably being secured to the rear anchor plate by another bolted anchor mechanism 24, secured through bolt holes 25, as best represented in FIG. 2.

Figure 2:
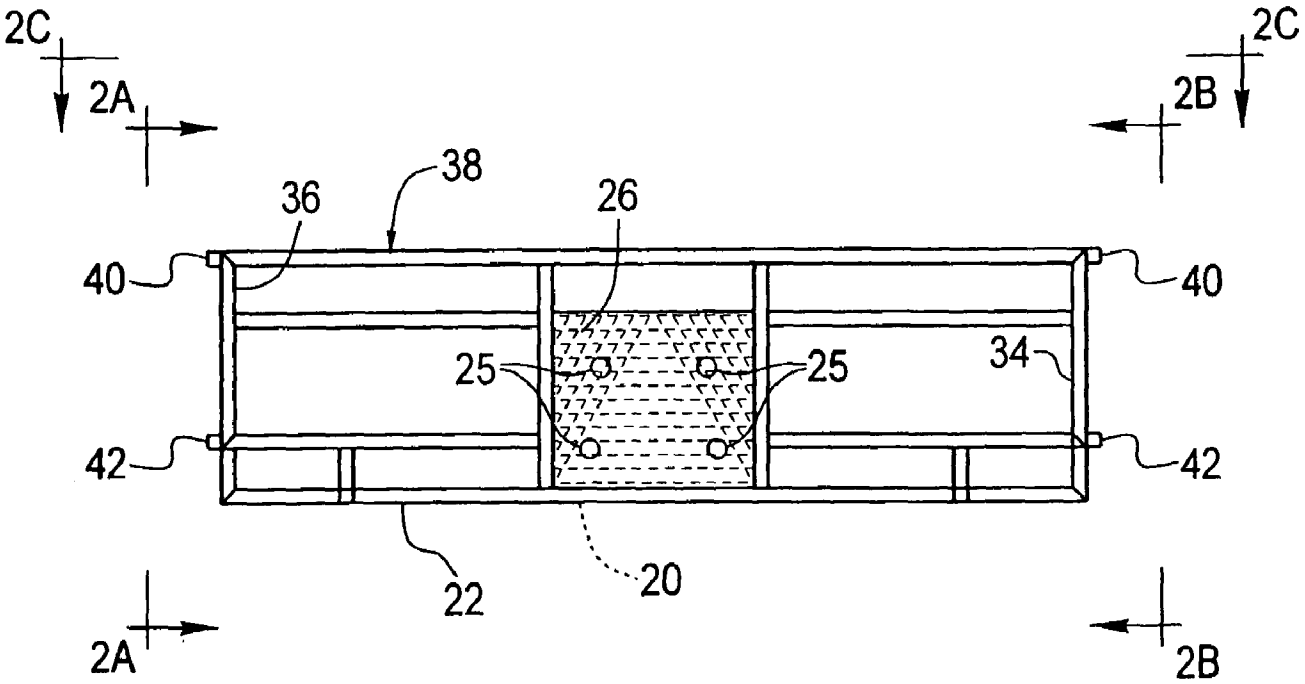
FIG. 2 is a side elevational view of the rear wall of the platform.
Figure 2A:
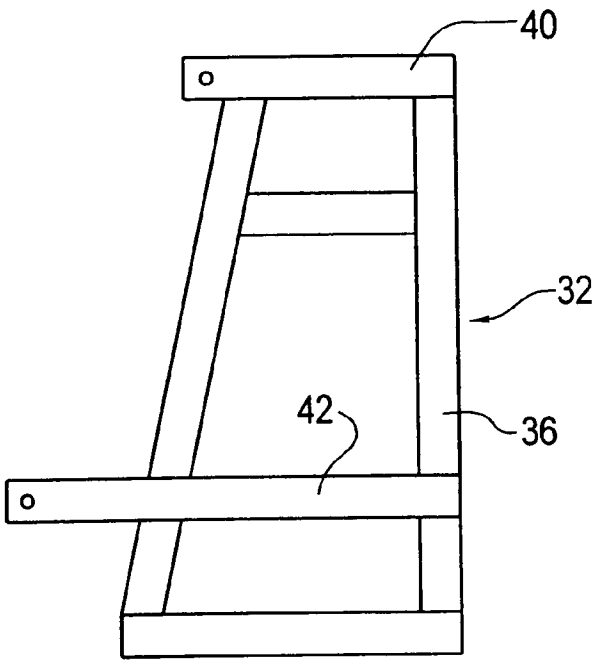
FIG. 2A is a view taken along the lines 2A-2A of FIG. 2.
Figure 2B:
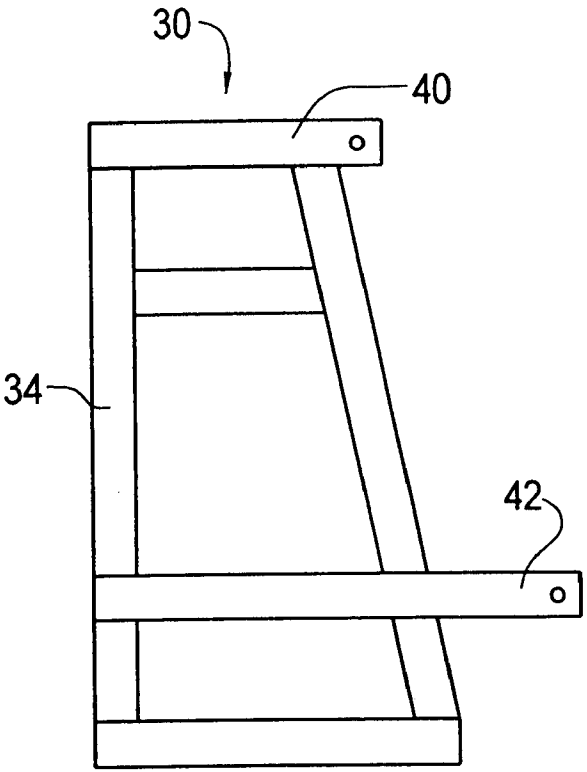
FIG. 2B is a view taken along the lines 2B-2B of FIG. 2.
Figure 2C:
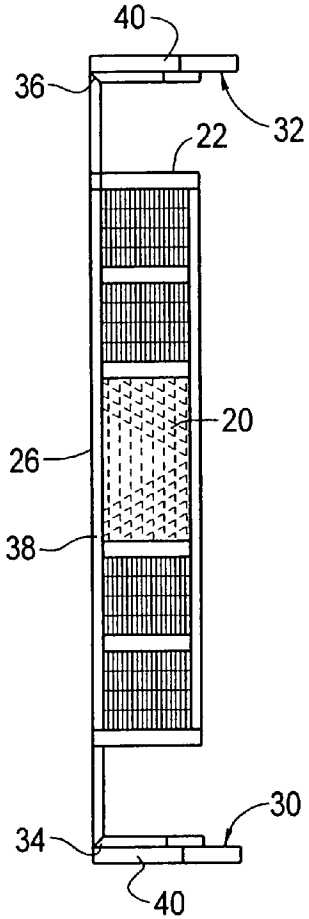
FIG. 2C is a view taken along the lines 2C-2C of FIG. 2.

A right sidewall frame 30, best represented in FIG. 2B and a left sidewall frame 32, best represented in FIG. 2A, are each attached, as for example, by welding, to and define the respective right and left side frame members 34 and 36 of the rear wall frame 38, as represented in FIG. 2. The respective sidewall frames 30 and 32 each have an upper elongated channel 40 and a lower elongated channel 42 parallel to one another, as shown in FIGS. 2A and 2B. The length of upper elongated channel 40 is approximately one half of the length of its adjacent lower elongated channel 42, to provide stronger support to floor panels telescopingly supported thereby, near the lower channel 42 on the platform 10.

Figure 3:
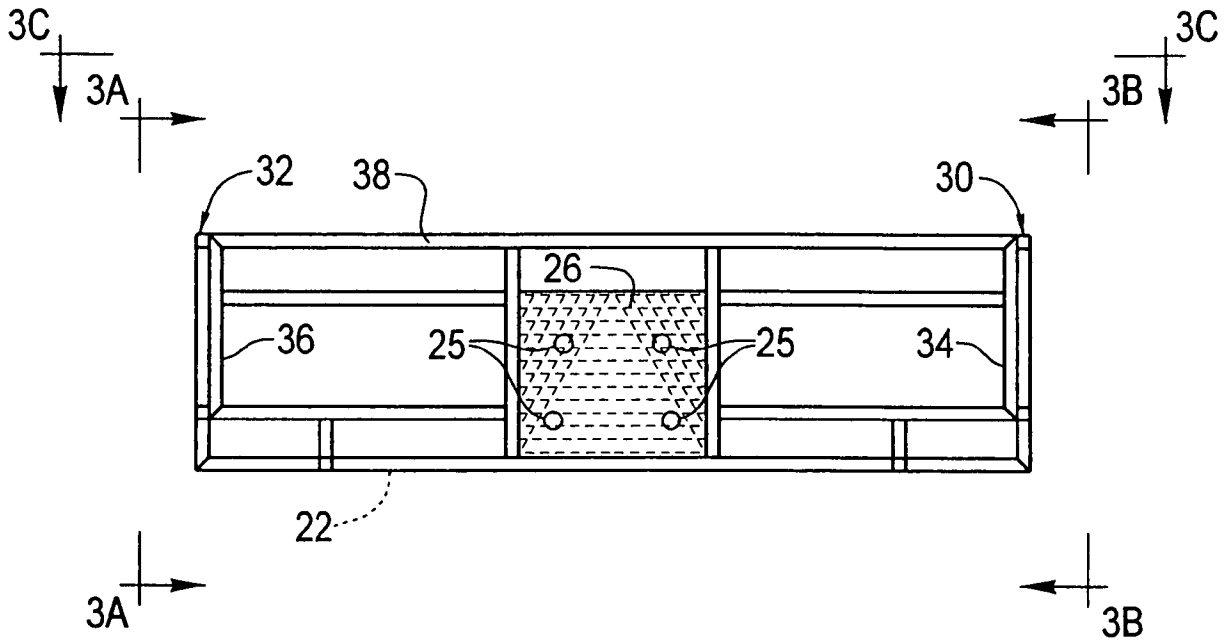
FIG. 3 is an elevational view of the rear wall of the platform, with portions of the floor and sidewalls thereattached.
Figure 3A:
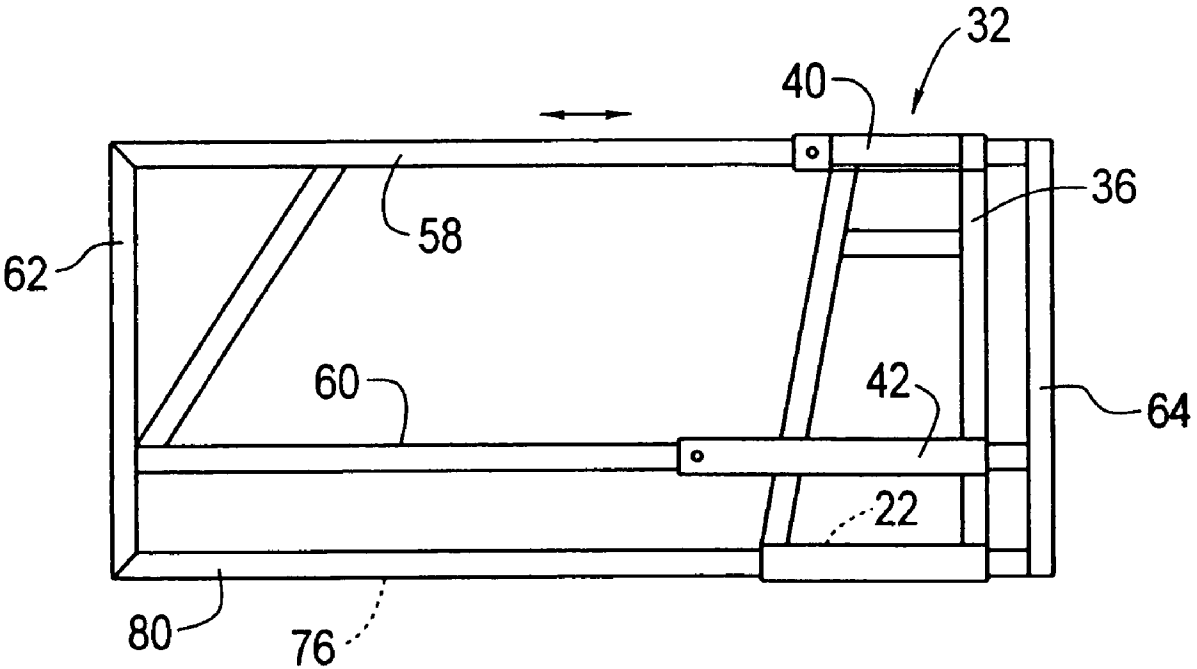
FIG. 3A is a view taken along the lines 3A-3A of FIG. 3.
Figure 3B:
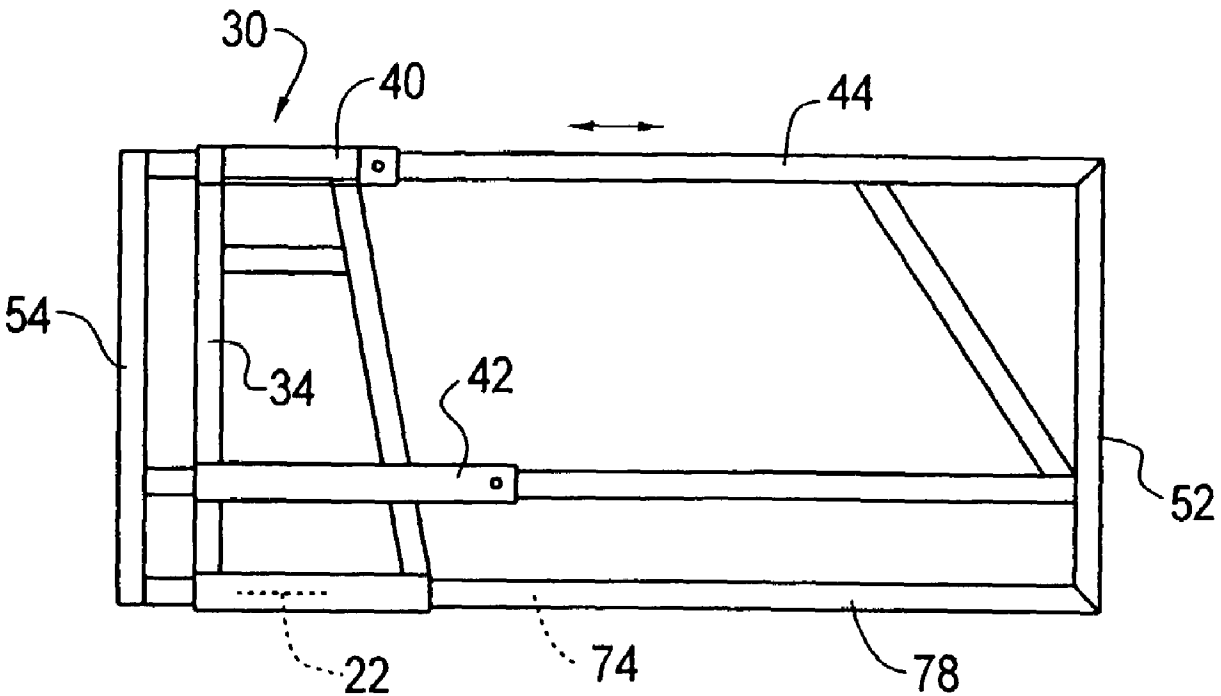
FIG. 3B is a view taken along the lines 3B-3B of FIG. 3.

The sidewall frames 30 and 32, connected to the ear wall frame 38, each slidably support a slidable side wall 44 and 46 respectively, as represented in FIGS. 3A and 3B. An upper right rail 48 of the right slidable sidewall 44, shown in FIG. 3B, telescopingly slides through the supportive upper elongated tubular channel 40 of the right sidewall frame 30. A lower rail 50 of the right slidable side wall 44 telescopingly slides through the supportive lower elongated tubular channel 42 of the right sidewall frame 30, as shown in FIG. 3B. The right slidable sidewall 44 has a transverse bar 52 at its distalmost end. The right slidable sidewall 44 has a right-side proximal transverse bar 54 at the rear or proximal end of the right slidable sidewall 44, as represented in FIG. 3B. The right-side proximal transverse bar 54 closely butts into a right sidewall frame 38 transverse bar edge 34 when the right slidable sidewall 44 is extended distally its maximum amount.

The left sidewall frame 32 has a left slidable sidewall 46 arranged in a similar manner to the aforementioned right sidewall frame 30. An upper left rail 58 of the left slidable sidewall 46 slides telescopingly through the supportive upper elongated tubular channel 40 of the left sidewall frame 32 as represented in FIG. 3A. A lower rail 60 of the left slidable sidewall 46 slides through the supportive lower elongated channel 42 of the left sidewall frame 32. The left slidable sidewall 46 has a transverse bar 62 at its distalmost end and it has a transverse bar 64 at its proximal end. The left-side proximal transverse bar 64 closely butts into a left sidewall frame 38 transverse bar edge 37 when the left slidable sidewall 46 is extended distally its maximum amount, as represented in FIGS. 3A and the uppermost representation of the assembly shown FIG. 4.

Figure 3C:
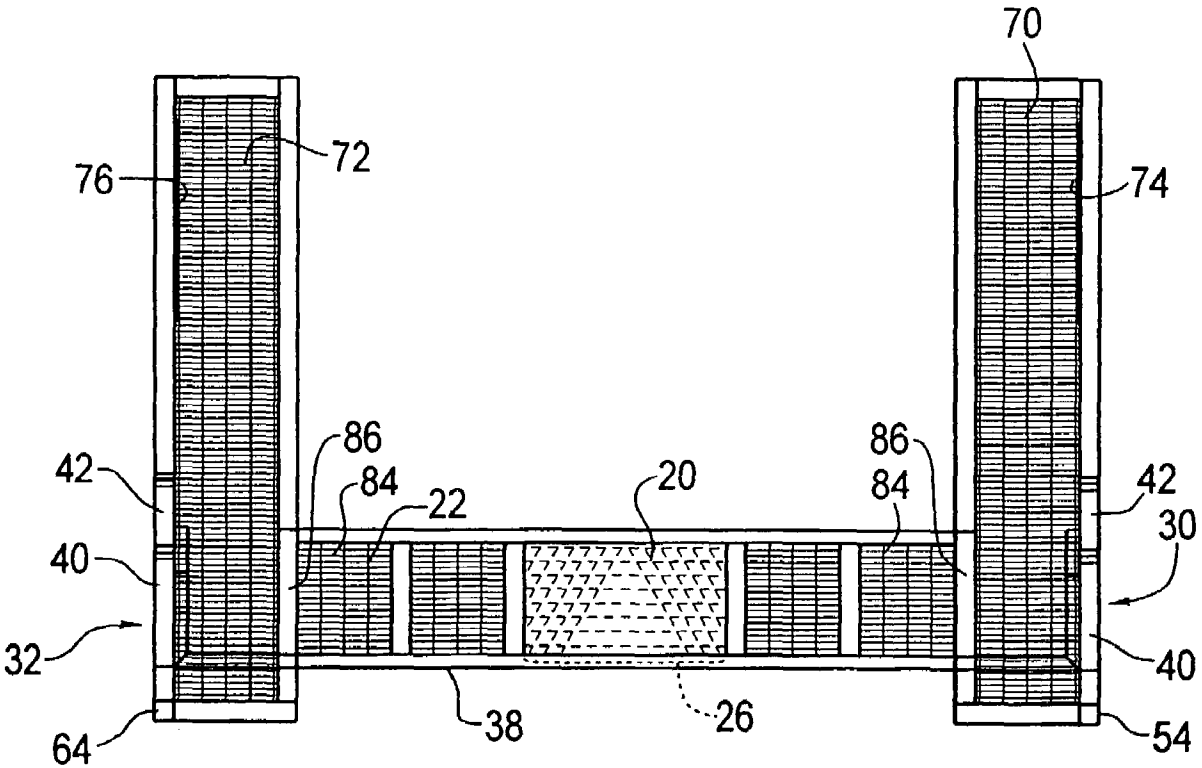
FIG. 3C is a view taken along the lines 3C-3C of FIG. 3.

The right slidable sidewall 44 and the left slidable sidewall 46 each have an elongated fold-down support plate or panel member 70 and 72 respectively, as represented in FIG. 3C. Each sidewall 44 and 46 is connected to their respective support panel or plate 70 and 72 by an elongated distally disposed hinge 74 and 76 connectively arranged along respective lower bar portions 78 and 80 thereof between the plate members 70 and 72. The support plates 70 and 72 are supported on their "hinge-opposite" sides by a lip thereof using ridably sliding support on the lower support frame 22. Each left and right slideable sidewall 46 and 44 has their lower bars 78 and 80, respectively, movable along with their respective left and right slidable sidewalls 44 and 46, the lower bar 78 and 80 of each being hingedly attached to the elongated side plates 70 and 72 which may also be pivoted into supported engagement with a portion of the rear floor 84 on each side of the lower anchor plate 20, which is part of the lower support frame 22. The outer edge of each rear floor 84 has a support edge 86 on which the elongated hingedly pivotable side support plate members 70 and 72 may themselves supportively slide/rest.

Figure 4:
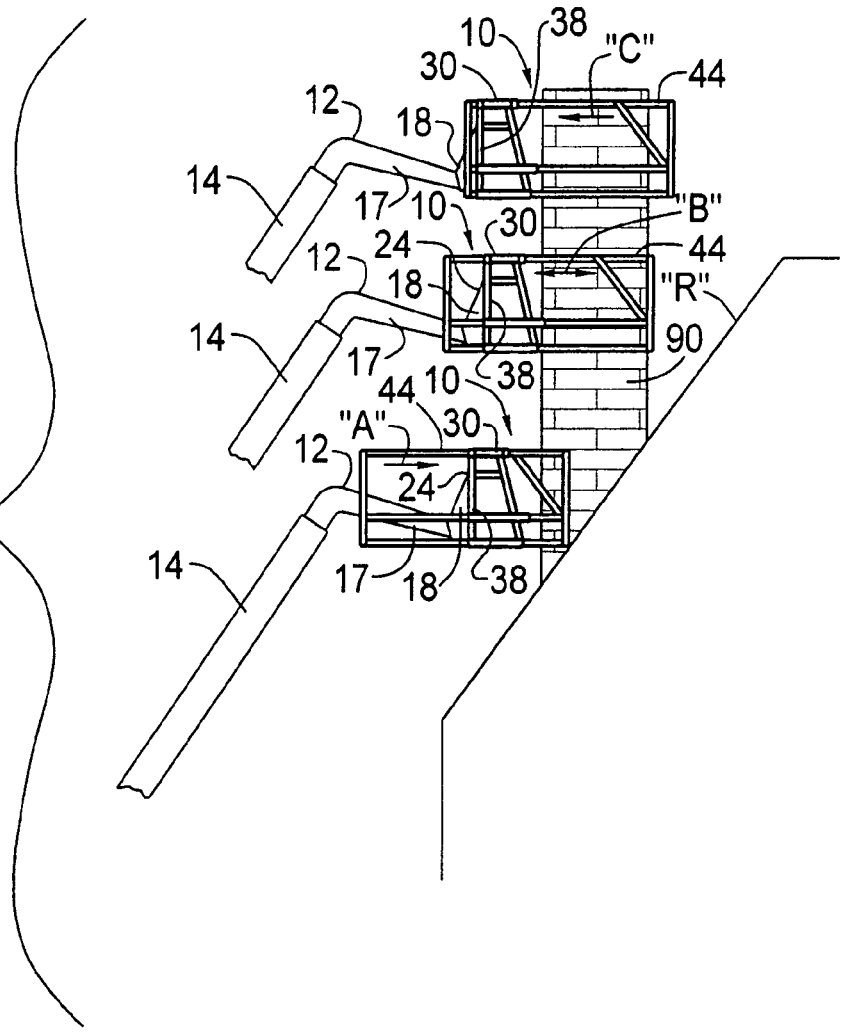
FIG. 4 is a side view of the articulable platform and its associated lift arm at different locations about a structure.
Figure 5:
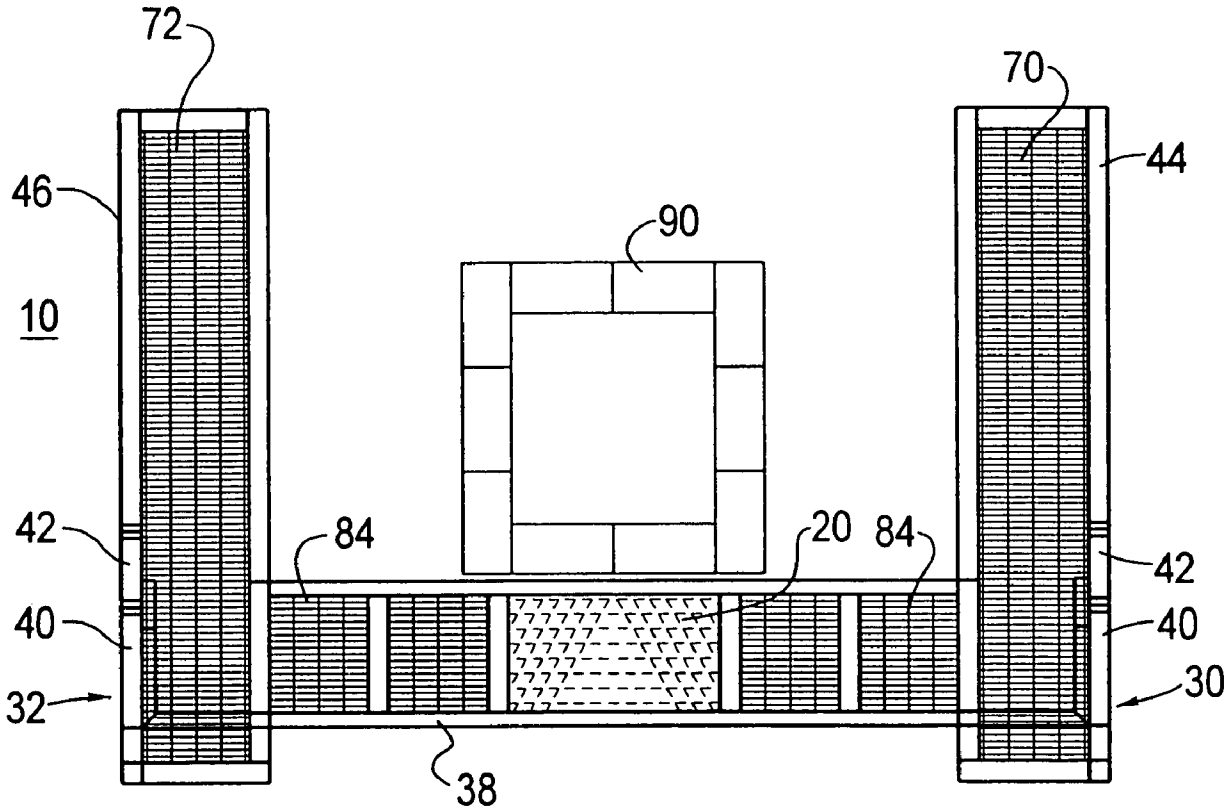
FIG. 5 is a plan view of the platform fully extended.

In operation of the articulable platform 10 on the distal end 17 of the articulable arm 12 on the lift truck 16, that articulable platform 10 may engageably receive between its elongated side floors 70 and 72, with a chimney or vertical structure 90 therebetween, as represented by side views in progressive stages of extended engagement of the arm 12, and concomitant extension of the sidewalls walls 44 and 46, and the platforms 70 and 72, as represented in FIG. 4, and in a plan view in FIG. 5, going from an "H" shape to a "U" shape in plan view. Those slidable sidewalls 44 and 46 may be moved forwardly and rearwardly, that is away from and back towards the rear wall frame 38, as represented by arrows A, B and C shown in the different positions of the sidewalls 44 and 46 in FIG. 4. For instance, if the platform 10 were utilized above a chimney 90 on a slanted roof "R", the slidable sidewalls 44 and 46 would only be independently extended from their respective right sidewall frame 44 and left sidewall frame 46 enough to clear the sides of the chimney without damaging any inclined roof "R" thereadjacent, but the distal ends may rest upon such roof"R" as necessary.

Figure 6:
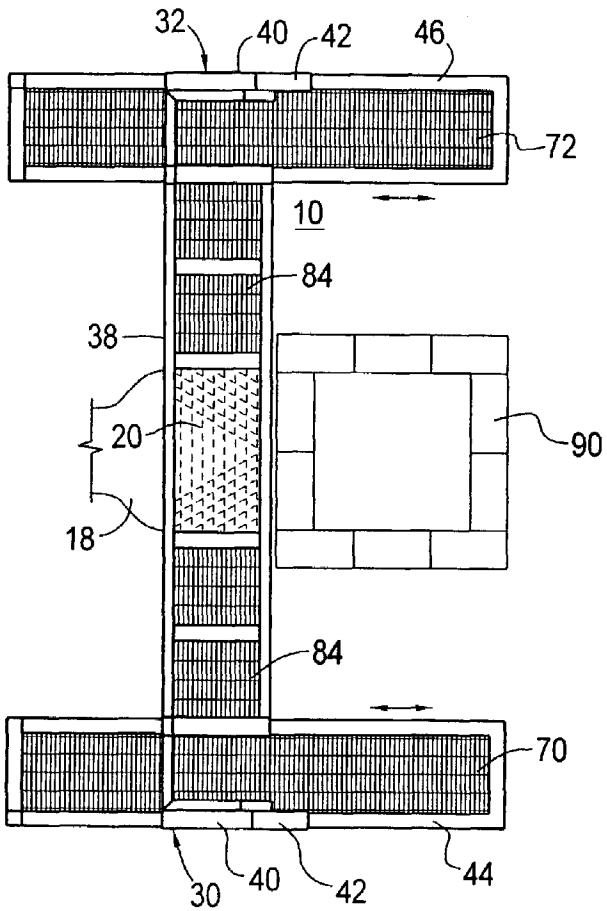
FIG. 6 is a plan view of the platform partially extended.

To fully surround a chimney or structure 90, as represented in a plan view in FIG. 5, those independently slidable sidewalls 44 and 46 and their respective hingedly associated support plates 70 and 72 would be extended away from the rear wall frame 38 so as to provide the elongated side floors their full extendibility thereadjacent, as shown in FIG. 5. FIG. 6 represents a plan view of the platform 10 in a partially extended mode, relative to the chimney 90, and shows the platform's configuration in the "H" shape..

Figure 7:
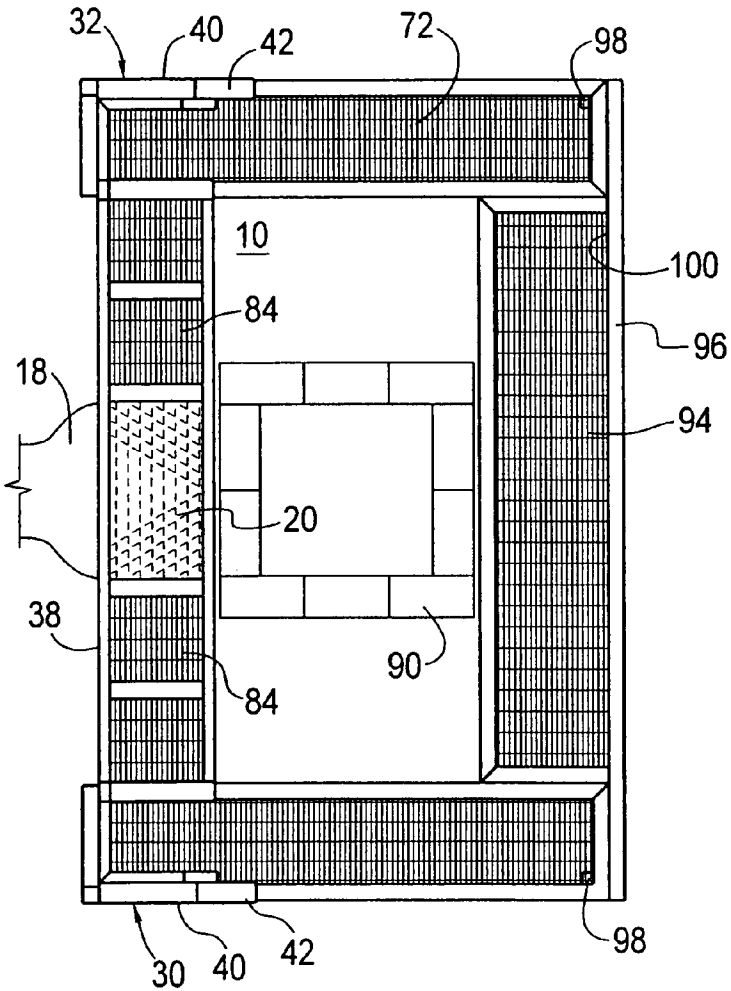
FIG. 7 is a plan view of the platform with a front floor thereattached.

It is further contemplated that an elongated, rectilinearly shaped front floor plate 94 with a hingedly attached front wall 96 may be adjustably and removably disposed between the respective distalmost ends of the respective properly reinforced supportive elongated side plates 70 and 72, as represented in FIG. 7. The front floor plate 94 preferably includes a proper corner attachment coupler 98 secured at each end of the front of the floor plate wall 96 to the ends of the respective left and right slidable sidewalls 44 and 46. The front wall 96 and front floor plate 94 may be hingedly attached to one another by an elongated hinge 100 or weldably attached along their connective adjacent portions thereof.

Figure 8:
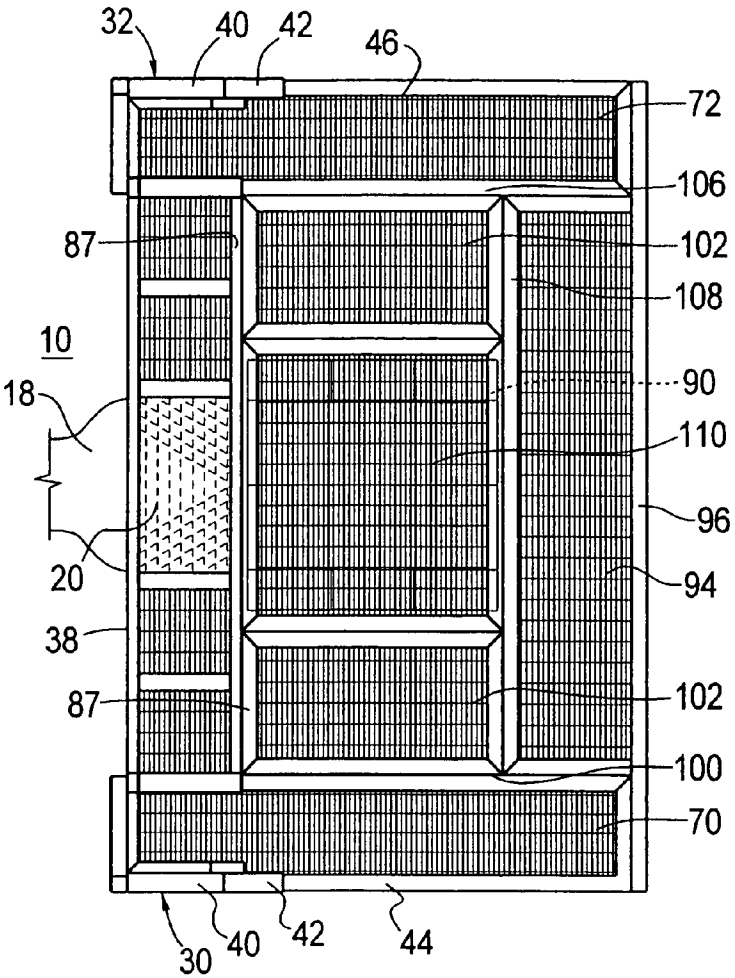
FIG. 8 is a plan view of a platform with a number of floor inserts shown arranged therein.
Figure 9:
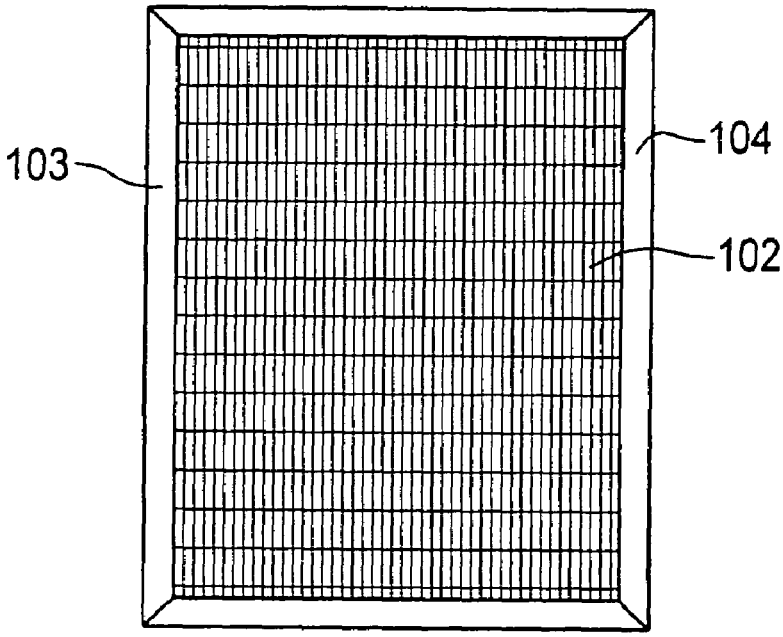
FIG. 9 is a plan view of an insert utilized in the floor plan of the present articulated platform.

An arrangement of rectilinear Inserts 102 may be disposed between the chimney 90 and the elongated edges of the elongated side floors 70 and 72, and the edges 87 of the rear floor 84 and the front floor 94 for in-close support of personnel and material on the platform 10, as is represented in FIG. 8. Such an insert 102 is represented in FIG. 9, in a plan view thereof. The insert 102 comprises a lipped rectilinear frame 104 having edge shoulder portions which properly rest upon the adjacent edges 106 and 108 of the floors 70 and 72 and the front plate 94, respectively, as represented in FIG. 8. Also shown in FIG. 8 is a central support plate 110, above the chimney 90, which is shown in dashed format. Such a central plate 110 has peripheral shoulder edges for proper restive support on adjacent peripheral plates 102, 94 and 84, when needed. Angle iron members, not shown for clarity of views, may be arranged between the side floors 70 and 72 for as needed peripheral support of various panel members, where such support is proper.

Figure 10:
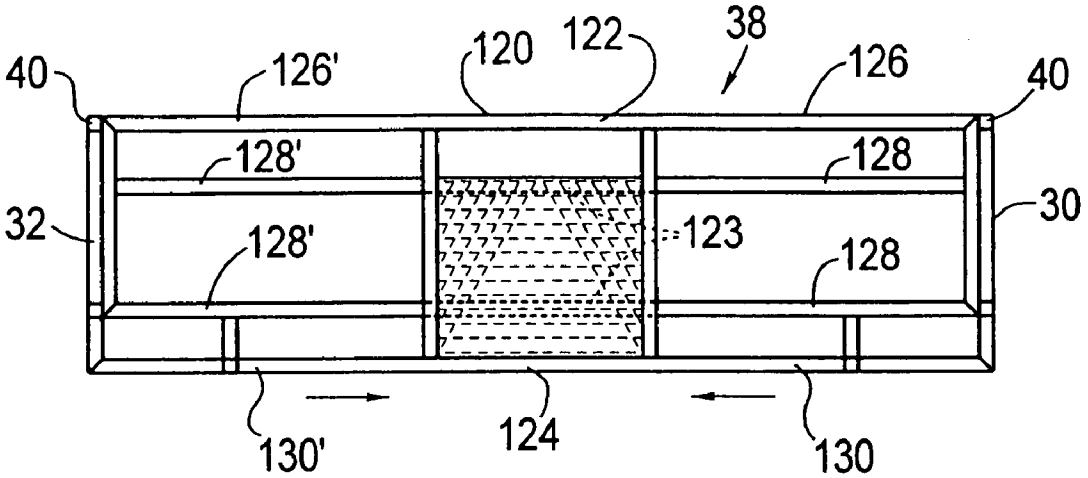
FIG. 10 is an elevational view of the rear wall showing a further embodiment of transverse telescoping adjustability thereof.
Figure 11:
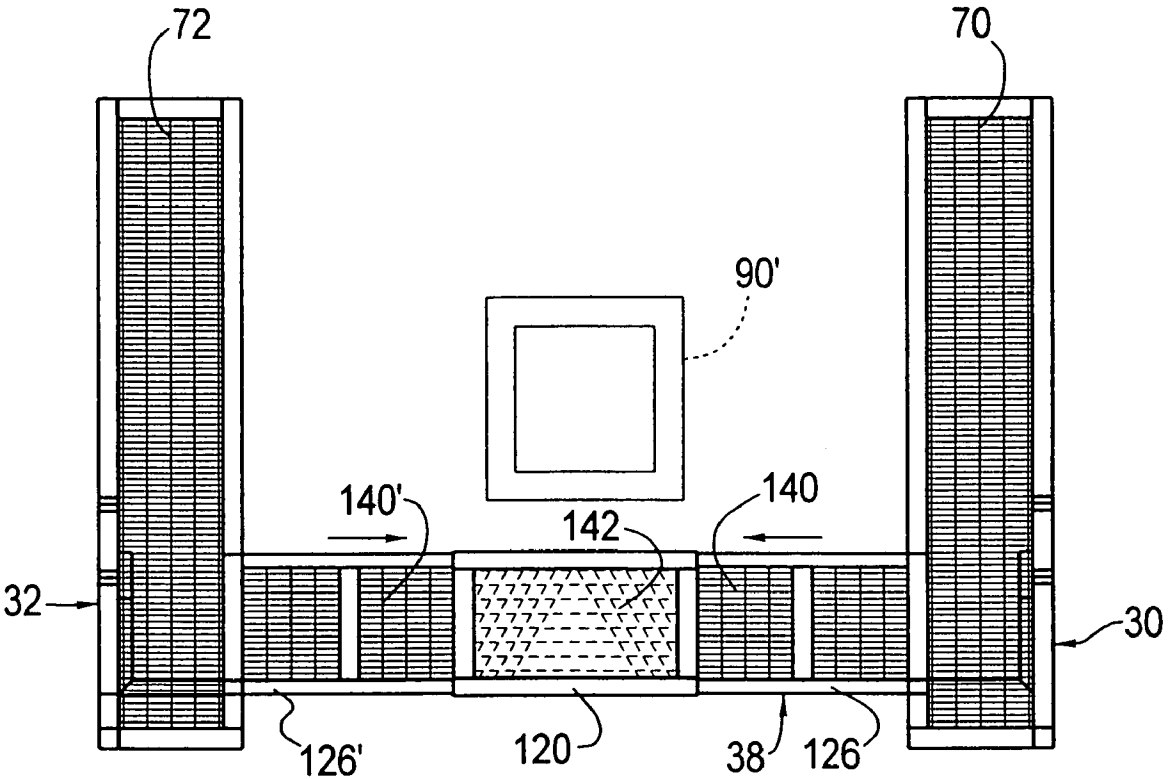
FIG. 11 is a plan view of the side platforms and the rear platform with its further embodiment of transverse adjustability thereof.

A further preferred embodiment of the present invention is shown in FIG. 10, wherein the rear wall frame 38 is divided into a unitary mid-portion 120 having upper, intermediate and lower rail members 122, 123 and 124, through which right end and left end wall portions rail members 126, 128 and 130, and 126', 128' and 130' of rear wall frame 38 respectively slide supported therethrough, telescopingly or otherwise surely supported in a proper manner thereby. Such an adjustable slidability to the right and left end wall portions 126 and 126' is also represented in FIG. 11, showing transversely shiftable deck panels 140 and 140' which are adjustably slidable under the "bridging" portion mid-portion deck panel 142. This side-independent limited transverse movability is important to provide floor panels with support to workers working on a narrow chimney or small project 90' requiring close work/material support. Note that such a mid-portion deck panel 142 may have an underside bridging member which is attachable to the generally "L" shaped platform securement member 18, to facilitate proper movement of such side floors without interference of the lift arm and its member 18. FIG. 11 shows the platform 10 in a plan view somewhat representing the "U" shape.

The invention thus comprises a support frame platform assembly generally of"H" shape in a plan view, independently slidably adjustable both "forwardly and rearwardly" and "widthwise" to a "U" shape or vice versa, for providing an adjustable platform for supporting workers and supplies about an elevated project such as for example, a chimney. The platform assembly has an elongated rectilinear floor panel "bridging" arrangement with an attached adjacent rear wall member supportively between a pair of adjustable sidewall and side floor panels at each end thereof. The sidewalls and side floor panels are adjustably movable independently forwardly and rearwardly with respect to the rear wall member. The rear wall member and its associated rectilinear floor panel arrangement are sideways adjustable in a telescoping or sliding manner with respect to the central portions of the rear wall and the elongated rectilinear floor panels, to permit the side walls and their associated floor panels to squeeze closer to a narrow chimney against which the platform assembly may be lifted. The platform itself is attached to the distal end of an articulable arm of a power lift truck for lifting of the platform up to and around an elevated chimney.

We claim:

1. An articulable platform, adjustable to and from an "H" shape to a "U" shape, said platform being attachable to the distal end of an articulable support arm of a transport vehicle, said platform arranged to adjustably surround an elevated chimney on at least three sides thereof, said platform comprising:

a rectilinear lower anchor plate centrally disposed within an elongated rectilinearly shaped lower support frame bridging member;

a rectilinear rear anchor plate connected perpendicularly to said lower anchor plate, said rectilinear rear anchor plate being centrally and connectively disposed within an elongated rectilinear rear wall bridging member;

a right sidewall frame and a left sidewall frame connected to respective end portions of said elongated rear wall frame, and also connected to respective end portions of said lower support frame bridging member; and a right sidewall slidably disposed within said right sidewall frame, and a left sidewall slidably disposed within said left sidewall frame, to provide adjustable "side" portions to said platform, said side portions being movable away from and returnable towards said rear wall frame, and articulable around an elevated structure for supporting personnel and equipment thereat.

2. The articulable platform as recited in claim 1, wherein said left slidable sidewall and said right slidable sidewall each have an elongated lower frame portion with a hinge thereon, each of said hinges being attached to an elongated side floor, each of said side floors being in pivotable engagement with said lower support plate bridging member of said platform.

3. The articulable platform as recited in claim 2, wherein each of said slidable sidewalls are movable independently of one another.

4. The articulable platform as recited in claim 2, wherein an elongated front floor is nestably disposable between said elongated side floors when said side floors are disposed in a horizontal orientation.

5. The articulable platform as recited in claim 4, wherein said front floor is hingedly attached to a front wall to provide full peripheral enclosure by a succession of wall members on said platform in an elevated orientation, while surrounding a chimney.

6. The articulable platform as recited in claim 4, wherein said platform includes a plurality of plate inserts, said plate inserts being supported upon edge portions of said hingedly attached side floors and said front floor.

7. The articulable platform as recited in claim 1, wherein said right and left sidewall frames have elongated channels, and said slidable sidewalls have elongated structure members which are arranged to slide through said channels for support of said side walls in said side wall frames.

8. The articulable platform as recited in claim 1, wherein said rectilinear rear wall frame bridging member is divided into a stationary mid portion adjustably supporting a right and a left portion of said wall frame to permit independent limited transverse adjustment of said right and left portions thereof with respect to said mid portion bridging member of said rear wall frame.

9. The articulable platform as recited in claim 7, wherein said elongated channels of said side wall frames comprise a shorter upper channel and a longer lower channel for proper support of said slidable sidewalls which are arranged to slide through said channels.

10. A method of supporting a work crew on an elevated chimney work site, comprising the steps of:

attaching a generally "H" shaped articulable platform assembly to the distal end of an articulable support arm of a transport vehicle, wherein said platform is arranged to adjustably surround an elevated chimney on at least three sides thereof, wherein said platform is comprised of a rectilinear lower anchor plate centrally disposed within an elongated lower support frame, a rectilinear rear anchor plate connected perpendicularly to said lower anchor plate for attachment to an articulable arm on a mobile transport, said rectilinear rear anchor plate being centrally and connectively disposed within an elongated rectilinear rear wall frame, a right sidewall frame and a left sidewall frame connected to respective end portions of said elongated rear wall frame, and connected to respective end portions of said lower support frame, a right slidable sidewall telescopingly slidably disposed within said right sidewall frame, and a left slidable sidewall telescopingly slidably disposed within said left sidewall frame, to provide adjustable portions thereof around an elevated structure for supporting personnel and equipment therefore;

moving said right sidewall and said left sidewall independently forwardly and rearwardly with respect to said rear wall frame and to one another to adjust the distribution of the sides of said platform relative to said chimney.

11. The method as recited in claim 10, including:

moving said sidewalls so as to form a "U" shape with said articulable platform.

12. The method as recited in claim 10, including the step of:

adjustably moving an arrangement of panel portions and said sidewalls transversely with respect to said rectilinear rear anchor plate to permit a proper closer support surface for a narrow chimney work site.

13. The method as recited in claim 10, including the step of:

placing a shoulder edge of a further rectilinear support frame adjacent to and supportively on an edge of at least two adjacent said rectilinear support panel plates on said platform assembly.

14. The method as recited in claim 10, wherein said bridging portion of said platform has a mid portion thereof which is fixedly secured to said articulable support arm.

15. An adjustable platform for supporting workers and supplies about an elevated work site, said platform movably supportable on an articulable support arm, said platform comprising an elongated rectilinear bridging panel arrangement and an elongated floor and railing assembly at each end thereof, wherein each elongated floor and railing assembly are independently movable on support members forwardly and rearwardly with respect to said bridging panel arrangement to change said platform from an "H" shape to a "U" shape as required.

16. The adjustable platform as recited in claim 15, wherein said bridging panel arrangement is elongatedly adjustable to change the width of said platform relative to a work project dimension.

* * * * *